US009682307B2

(12) United States Patent
Dalebout

(10) Patent No.: US 9,682,307 B2
(45) Date of Patent: Jun. 20, 2017

(54) EXERCISE EQUIPMENT WITH INTEGRATED DESK

(71) Applicant: ICON Health & Fitness, Inc., Logan, UT (US)

(72) Inventor: William T. Dalebout, North Logan, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 0 days.

(21) Appl. No.: 14/641,749

(22) Filed: Mar. 9, 2015

(65) Prior Publication Data

US 2015/0251048 A1 Sep. 10, 2015

Related U.S. Application Data

(60) Provisional application No. 61/950,657, filed on Mar. 10, 2014.

(51) Int. Cl.

| | |
|---|---|
| ***A63B 22/02*** | (2006.01) |
| ***A63B 71/06*** | (2006.01) |
| *A47B 23/02* | (2006.01) |

(52) U.S. Cl.

CPC ..... *A63B 71/0686* (2013.01); *A63B 22/02* (2013.01); *A47B 23/02* (2013.01); *A47B 2220/06* (2013.01); *A63B 22/025* (2015.10); *A63B 22/0235* (2013.01); *A63B 2071/065* (2013.01); *A63B 2071/0625* (2013.01); *A63B 2071/0675* (2013.01); *A63B 2208/0228* (2013.01); *A63B 2210/50* (2013.01); *A63B 2220/10* (2013.01); *A63B 2220/18* (2013.01);

(Continued)

(58) Field of Classification Search

CPC . A63B 22/02; A63B 22/0207; A63B 22/0214; A63B 22/0221; A63B 22/0228; A63B 22/0235; A63B 22/0242; A63B 22/0271; A63B 22/0278; A63B 22/0285; A63B 22/0292

See application file for complete search history.

(56) References Cited

U.S. PATENT DOCUMENTS 1,919,627 A * 7/1933 Fitz Gerald ..... A63B 22/02 482/54
4,638,969 A * 1/1987 Brown ..... F16M 11/12 248/122.1

(Continued)

FOREIGN PATENT DOCUMENTS

TW M348536 1/2009

OTHER PUBLICATIONS

English Translation of Taiwan Office Action and Search Report issued for 104107625 on Aug. 26, 2016.

(Continued)

*Primary Examiner* — Loan H Thanh
*Assistant Examiner* — Rae Fischer
(74) *Attorney, Agent, or Firm* — Holland & Hart LLP

(57) ABSTRACT

An exercise apparatus include a base frame and a treadmill deck movably coupled with the base frame. The exercise apparatus also includes a desk with a working surface. The working surface is selectively positionable between a first position where the working surface lies in a first plane, and a second position where the working surface lies in a second plane. The first plane and the second plane are angularly disposed relative to each other.

16 Claims, 9 Drawing Sheets

(52) U.S. Cl.
CPC ..... *A63B 2220/20* (2013.01); *A63B 2220/30* (2013.01); *A63B 2225/09* (2013.01); *A63B 2225/093* (2013.01); *A63B 2225/50* (2013.01); *A63B 2225/685* (2013.01); *A63B 2225/687* (2013.01); *A63B 2230/01* (2013.01); *A63B 2230/75* (2013.01)

(56) References Cited

U.S. PATENT DOCUMENTS 5,257,701 A * 11/1993 Edelson ..... A47B 3/10 108/116
5,630,566 A * 5/1997 Case ..... A47B 23/046 248/122.1
5,672,140 A * 9/1997 Watterson ..... A63B 22/0012 482/54
7,335,147 B2 * 2/2008 Jones ..... A63B 71/0622 433/25
7,780,578 B2 * 8/2010 Packham ..... A63B 22/02 482/4
7,892,148 B1 * 2/2011 Stauffer ..... A63B 22/0235 482/51
D691,223 S * 10/2013 Hao ..... D21/694
2004/0176215 A1 9/2004 Gramaccioni
2005/0148440 A1 * 7/2005 Denton ..... A63B 71/0622 482/54
2006/0040797 A1 2/2006 Chang
2006/0247109 A1 11/2006 Powell
2008/0234111 A1 9/2008 Packham
2012/0088633 A1 4/2012 Crafton
2012/0174833 A1 7/2012 Early et al.
2014/0360413 A1 * 12/2014 Schenk ..... A47B 87/002 108/50.11

OTHER PUBLICATIONS

English translation of the abstract of TWM348536. Jan. 11, 2009.
International Search Report issued for PCT/US2015/019584 on Nov. 19, 2015.

* cited by examiner

EXERCISE EQUIPMENT WITH INTEGRATED DESK

RELATED APPLICATIONS

This application claims priority to provisional Patent Application No. 61/950,657 titled "Exercise Equipment with Integrated Desk" filed Mar. 10, 2014, which application is hereby incorporated by reference for all that it discloses.

BACKGROUND

One difficulty that people face in getting an appropriate amount of exercise is scheduling adequate time to exercise. Often, people fail to exercise because they fail to arrange a time to go to the gym or to simply go outside to run, bike, or participate in some other activity. Often, people utilize exercise equipment in their home in an effort to make exercising more convenient and to alleviate scheduling concerns because they can theoretically exercise whenever they are home. However, even with such equipment, some people fail to exercise as much as they desire.

Another difficulty that people face in staying in shape is the amount of time that they spend involved in sedentary activities. For example, many people work in an office environment where they sit at a desk for 8 hours or more a day. Sitting at a desk for such extended periods of time can lead to physical issues including weight gain, muscle atrophy, and back problems.

There are numerous types of apparatuses and devices that are currently available to help individuals exercise and maintain a desired level of health and fitness. One popular type of exercise equipment is a treadmill. Treadmills conventionally include a continuous or circuitous belt positioned about one or more rollers associated with a deck (sometimes also referred to as a platform). One of the rollers is often driven to move the belt in a circuitous fashion while a user walks, jogs or, runs on the belt. As the user exercises on the treadmill, his or her feet typically land on the belt at a location that is supported by the belt and deck.

Some treadmills have tried to provide a user with more convenience in exercising such as constructing the treadmill so that the user do activities on the treadmill at the same time he or she is exercising. For example, U.S. Patent Publication No. 2008/0234111 issued to Packham describes a mid-deck hinged treadmill deck that allows the deck of a treadmill to fold into small spaces which is useful to any use where space is limited. A few examples of such uses or applications are treadmills that fold under desk tops or treadmills that fold into furniture or treadmills that fold out of wall fixtures. The smaller volume required to box, ship and store the mid-deck hinged treadmill also lowers freight and storage costs simply because more units will fit into a shipping container or warehouse space. To function properly the mid-deck hinged treadmill deck requires a rear mechanism that loosens the rear roller when it is being folded or unfolded and then locks or tightens the rear treadmill roller when it is used. Other treadmills are described in U.S. Patent Publication Nos. 2012/0088633 issued to Crafton and 20120174833 issued to Early, et al. Each of these references are herein incorporated by reference for all that they disclose.

SUMMARY

In an preferred embodiment of the invention, an exercise apparatus include a frame and a treadmill deck movably coupled with the frame. The exercise apparatus also includes a desk with a working surface. The working surface is selectively positionable between a first position where the working surface lies in a first plane, and a second position where the working surface lies in a second plane. The first plane and the second plane are angularly disposed relative to each other.

One aspect of the invention that may be combined with one or more other aspects herein, the exercise apparatus includes a treadmill deck movably coupled with the frame.

One aspect of the invention that may be combined with one or more other aspects herein, the exercise apparatus includes a desk with a working surface, the working surface being selectively positionable between a first position where the working surface lies in a first plane, and a second position where the working surface lies in a second plane, the first plane and the second plane are angularly disposed relative to each other.

One aspect of the invention that may be combined with one or more other aspects herein, a first columnar member is coupled with the frame and a second columnar member is coupled with the frame, wherein the working surface is supported by the first and second columnar members.

One aspect of the invention that may be combined with one or more other aspects herein, a first support arm is coupled with the first columnar member and a second support arm is coupled with the second columnar member, and wherein the working surface is pivotally displaced relative to the first and second support arm from the first position to the second position.

One aspect of the invention that may be combined with one or more other aspects herein, a desk is coupled with the working surface and a pivotal connection between the desk and at least one of the first and second support arms.

One aspect of the invention that may be combined with one or more other aspects herein, an adjustment mechanism selectively maintains the working surface in at least one of the first and second positions.

One aspect of the invention that may be combined with one or more other aspects herein, the adjustment mechanism includes a first support member coupled with the working surface and a second support member that selectively engages the first support member at a selected position.

One aspect of the invention that may be combined with one or more other aspects herein, the first support member includes a plurality of slots and wherein the second support member includes a pin member that selectively engages the plurality of slots.

One aspect of the invention that may be combined with one or more other aspects herein, an adjustment mechanism that selectively maintains the working surface in at least one of the first and second positions.

One aspect of the invention that may be combined with one or more other aspects herein, the adjustment mechanism includes an actuator.

One aspect of the invention that may be combined with one or more other aspects herein, the actuator includes at least one of an electric motor, a hydraulic cylinder, and a pneumatic cylinder.

One aspect of the invention that may be combined with one or more other aspects herein, the treadmill deck is selectively displaceable between an operational position and a stored position.

One aspect of the invention that may be combined with one or more other aspects herein, at least one input device and at least one output device integrated into the desk.

One aspect of the invention that may be combined with one or more other aspects herein, the at least one input device includes at least one of a switch or a button.

One aspect of the invention that may be combined with one or more other aspects herein, the at least one output device includes a display.

One aspect of the invention that may be combined with one or more other aspects herein, an actuator that displaces the working surface of the desk from a first position to a second position in response to receiving a command.

One aspect of the invention that may be combined with one or more other aspects herein, the working surface is in a first angular orientation while in the first position and in a second angular orientation while in the second position.

One aspect of the invention that may be combined with one or more other aspects herein, the working surface is at a first height while in the first position and in a second height while in the second position.

One aspect of the invention that may be combined with one or more other aspects herein, a pair of columnar members extending from the frame, a pair of support arms coupled with the columnar members, and wherein the working surface is coupled with the pair of support arms.

One aspect of the invention that may be combined with one or more other aspects herein, a pivoting connection couples at least one of the pair of support arms and the working surface One aspect of the invention that may be combined with one or more other aspects herein, an exercise apparatus includes a base frame.

One aspect of the invention that may be combined with one or more other aspects herein, a treadmill deck movably coupled with the base frame, the treadmill deck including a deck frame, a pair of spaced apart rollers coupled to the deck frame, and a circuitous belt extending about the pair of the rollers, the treadmill deck being pivotally displaceable relative to the frame from a first position wherein the treadmill deck defines a running path, and a second position wherein the treadmill deck is in a stored state.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

Figure 1:
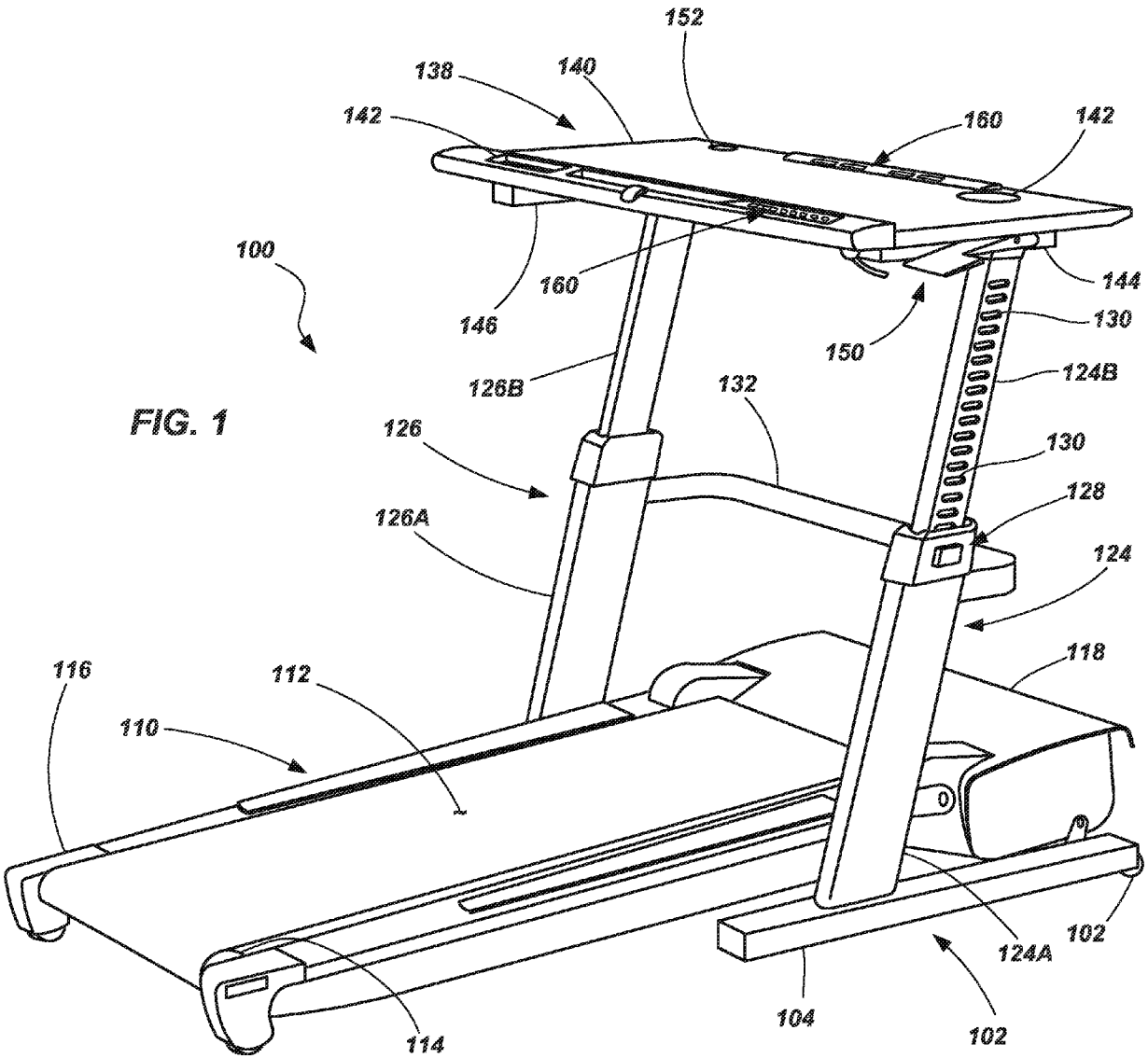
FIG. 1 is a perspective view of an example of an exercise apparatus with various components adjusted to specific positions in accordance with the present disclosure.

An exercise apparatus with a desk having a working surface is disclosed herein. The exercise apparatus may be a treadmill having a frame, a deck positioned within a footprint of the frame and a circuitous belt positioned about the deck. An adjustable desk may also be coupled to the frame. The desk may include a working surface that pivots out of the pathway of the running deck such that the deck may be folded or pivoted upwards into a stored position. The desk may be adjustable in a variety of ways and may include a number of other features as described below.

Referring to FIGS. 1-5, an exercise apparatus, such as a treadmill 100, is shown. The treadmill 100 includes a base frame 102 having a first side member 104 and a second side member 106 spaced apart from the first side member 104. One or more cross members 108 may extend between the side members 104, 106 to provide a desired amount of structural rigidity and stability to the frame 102.

Figure 4:
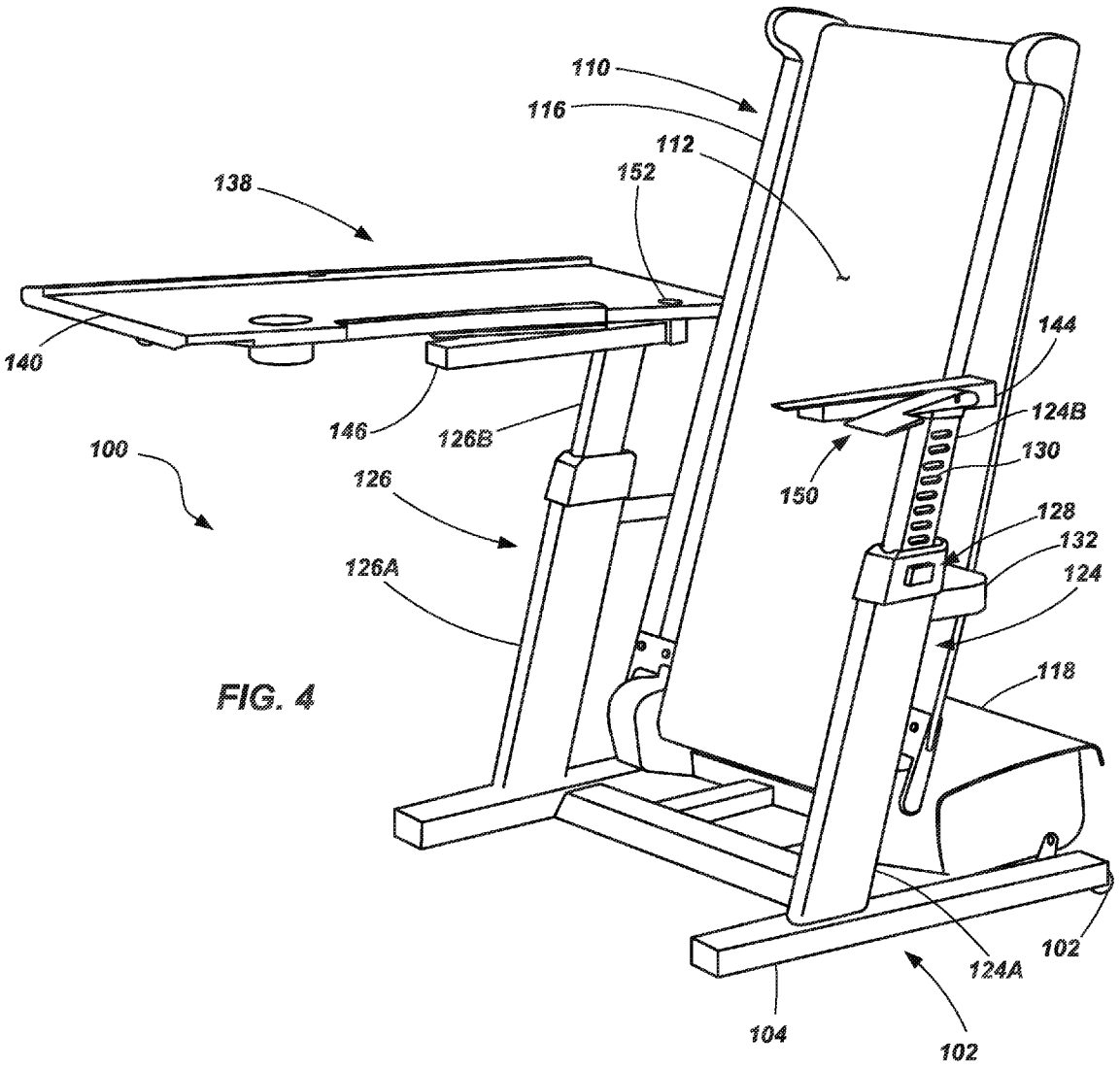
FIG. 4 is a perspective view of the exercise apparatus of FIG. 3 with the running deck pivoted to a vertical orientation.

A running deck 110 is pivotally coupled with the base frame 102. The running deck 110 includes a continuous or circuitous belt 112 disposed about a first roller 114 at one end of the deck frame 116 and a second roller (not specifically shown) at an opposing end of the deck frame 116. A supporting member may be positioned directly beneath the upper portion of the circuitous belt 112 to support the weight of a user while the belt is displaced over the supporting member. A drive, which may include an alternating current or a direct current motor, may be coupled to one of the rollers to drive the belt 112 about the rollers. In one embodiment, such a drive may be housed between the two side members 104, 106 and, if desired, beneath a hood, faring 118, or other structure. The pivotal connection between the deck 110 and the base frame 102 enables the deck 110 to be displaced between a useable or operational position (e.g., as shown in FIG. 1) and a stored position (e.g., as shown in FIG. 4).

Columnar members 124, 126 or other structural members are coupled with the base frame 102 (e.g., with the first side member 104 and second side member 106, respectively) and extend upwardly from the base frame 102. The columnar members 124, 126 may be coupled with the base frame 102 by any of a variety of techniques including, for example, bolts, brackets, other mechanical fasteners, by welding, or other material joining techniques. Each columnar member may include a first or lower member 124A, 126A and a second or upper member 124B, 124B coupled with their associated first/lower member in a telescoping fashion.

Figure 2:
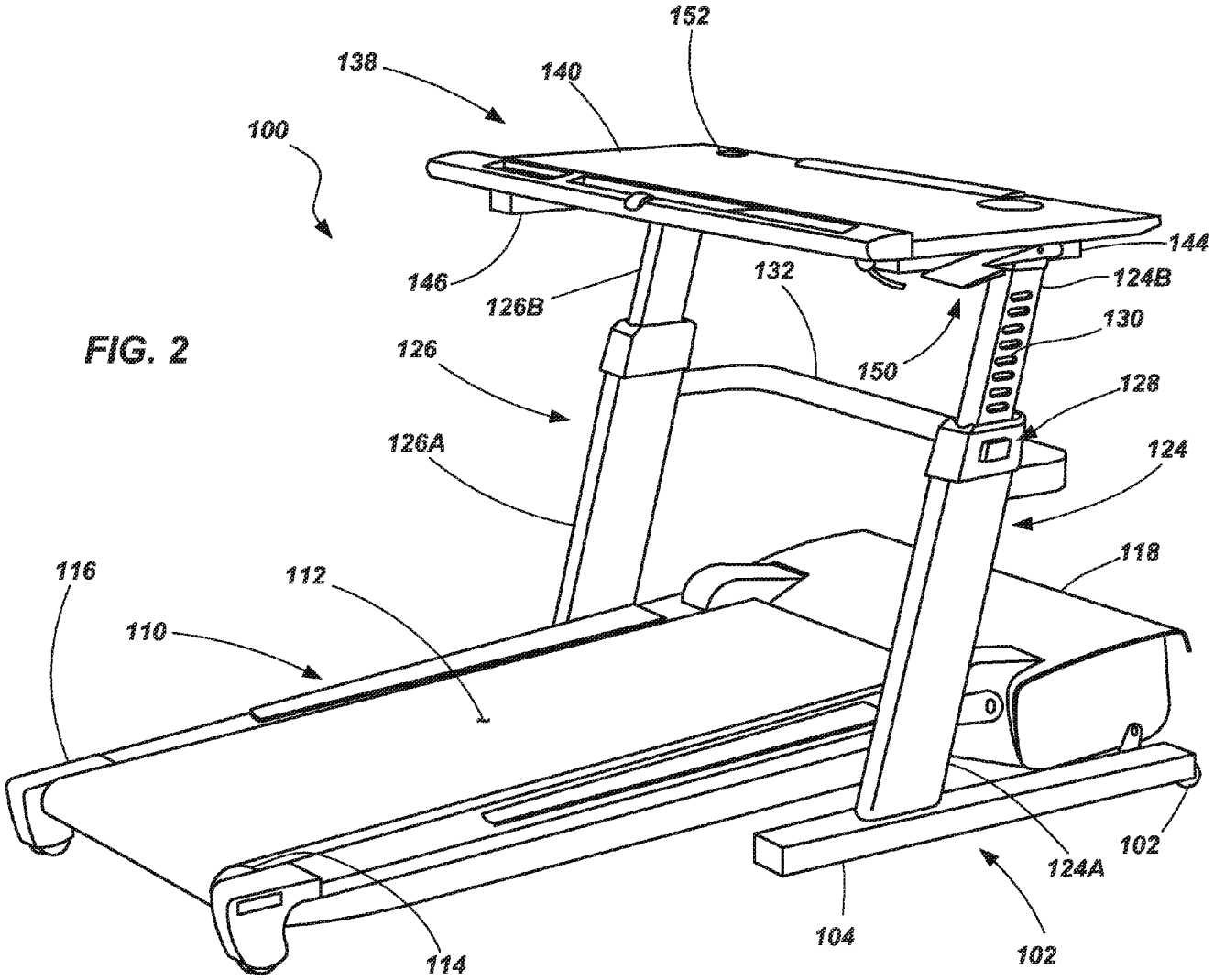
FIG. 2 is a perspective view of the exercise apparatus of FIG. 1 with the working surface adjusted to a different position than that depicted in FIG. 1.

An adjustment mechanism 128 may be associated with the columnar members 124, 126 and include, for example, a biased pin or a latch member associated with the lower member 124A, 126A that selectively engages apertures 130 or other features formed in the upper members 124B, 126B. The pin or latch may be biased into engagement with the apertures 130. A user may actuate the adjustment mechanism 128 to release the upper columnar members 124B, 126B to displace them relative to the lower columnar members 124A, 126A. This enables the upper members 124B, 126B to be selectively adjusted to a variety of heights. For example, FIG. 1 depicts the upper members 124B, 126B substantially extended from their respective lower members 124A, 126A while FIG. 2 depicts the upper members 124B, 126B partially retracted within their associated lower members.

In one embodiment, a separate adjustment mechanism may be associated with each columnar member 124, 126. In another embodiment, a single adjustment mechanism may be used to selectively release or lock both of the columnar members 124, 126 substantially simultaneously. A variety of mechanisms may be used. For example, a ratcheting type mechanism may be used wherein the upper columnar members 124B, 126B are enabled to be displaced upwards relative to the lower columnar members 124A, 126A simply by placing an upward force on such members (i.e., without the need to independently actuate an associated adjustment mechanism). Such a ratcheting mechanism may provide an automatic stop at incremental adjustments (e.g., 0.25 or 0.5 inches) preventing the upper columnar members 124B and 126B from being displaced back downward until selectively released by a user.

In one embodiment, additional features may be incorporated such as biasing members (e.g., springs or cushions) and or damping mechanisms coupled between the lower columnar members 124A, 126A and their associated upper columnar members 124B, 126B. Thus, with a biasing member and/or damping member, the adjustment mechanism may be in either a "locked" or "unlocked" state. When in the "unlocked" state, the biasing member and/or damping members can assist with the raising and lowering of the upper columnar members 124B, 126B relative to the lower columnar members 124A, 126A.

In other embodiments, an actuator (e.g., an electric motor, a jack screw, a hydraulic cylinder, or pneumatic cylinder) may be associated with the columnar members 124, 126 to adjust their height without a user applying an upward force.

One or more cross members or braces 132 may be coupled to the lower members to provide structural stability to the columnar members 124, 126. As shown in FIGS. 1-5, the brace 132 may bow out or extend toward the front of the treadmill 100 so as to accommodate the deck 110 when it is placed in a stored state (see FIG. 4). Additional cross members or bracing may be coupled to the upper members 124B, 126B, if desired.

A desk 138 may be coupled with the columnar members 124, 126. In some examples, the desk includes a working surface 140 upon which a user may place a variety of items. Such items may include a document, a computer monitor, a laptop computer, an electronic tablet, water bottle, an entertainment device, another type of item, or combinations thereof. One or more bins 142 or storage compartments may be formed within or otherwise coupled with the working surface 140 to hold items such as drinks, office supplies, or other objects. Support arms 144, 146 may be coupled to the columnar members 124, 126, respectively, and structurally support the working surface 140. The working surface 140 is pivotably coupled to one of the support arms (e.g., 146) or its associated columnar member (e.g., 126) and selectively latched to the other support arm (e.g., 144) or its associated columnar member (e.g., 124).

Figure 3:
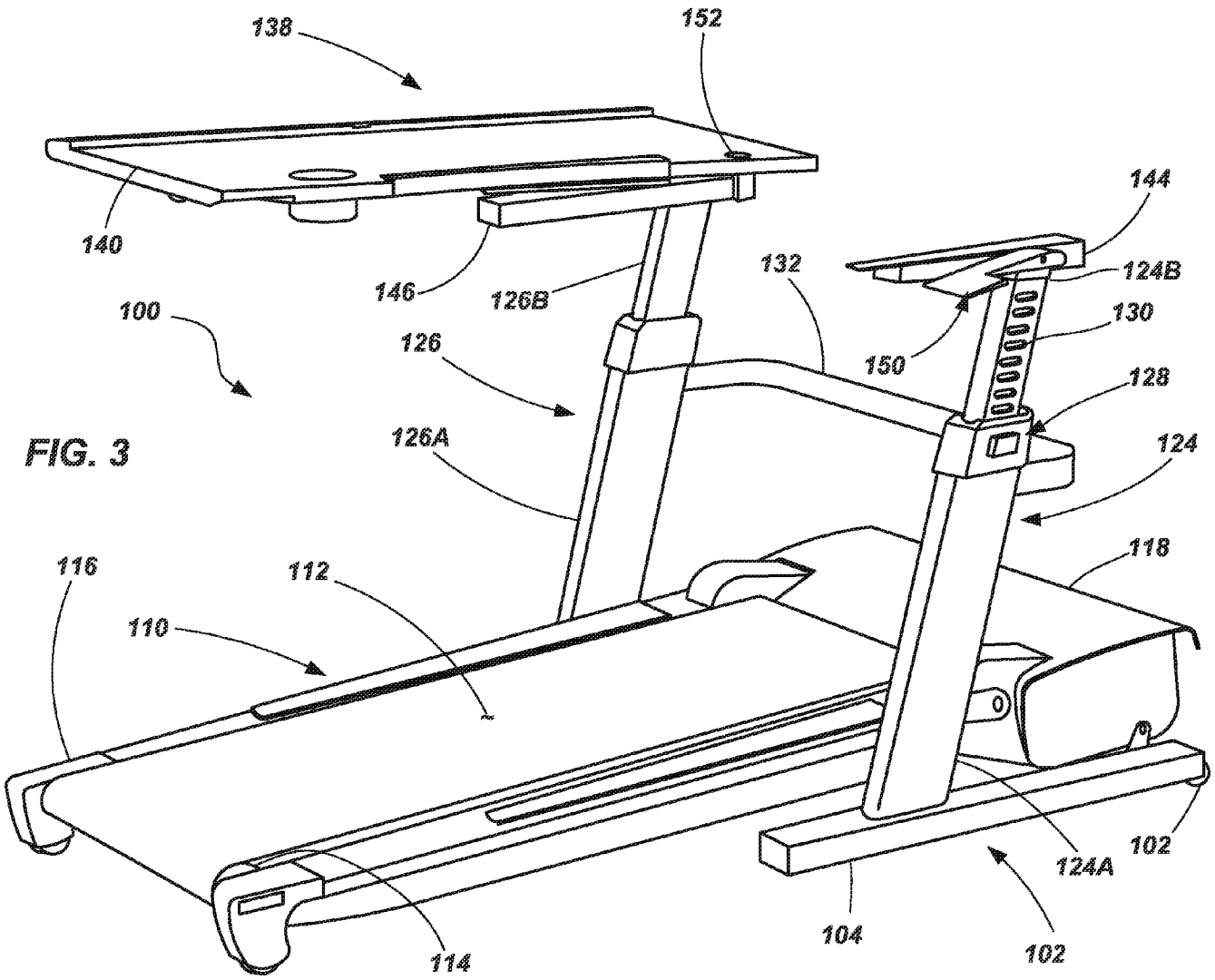
FIG. 3 is a perspective view of the exercise apparatus of FIG. 1 with the working surface pivoted away from its original position.
Figure 5:
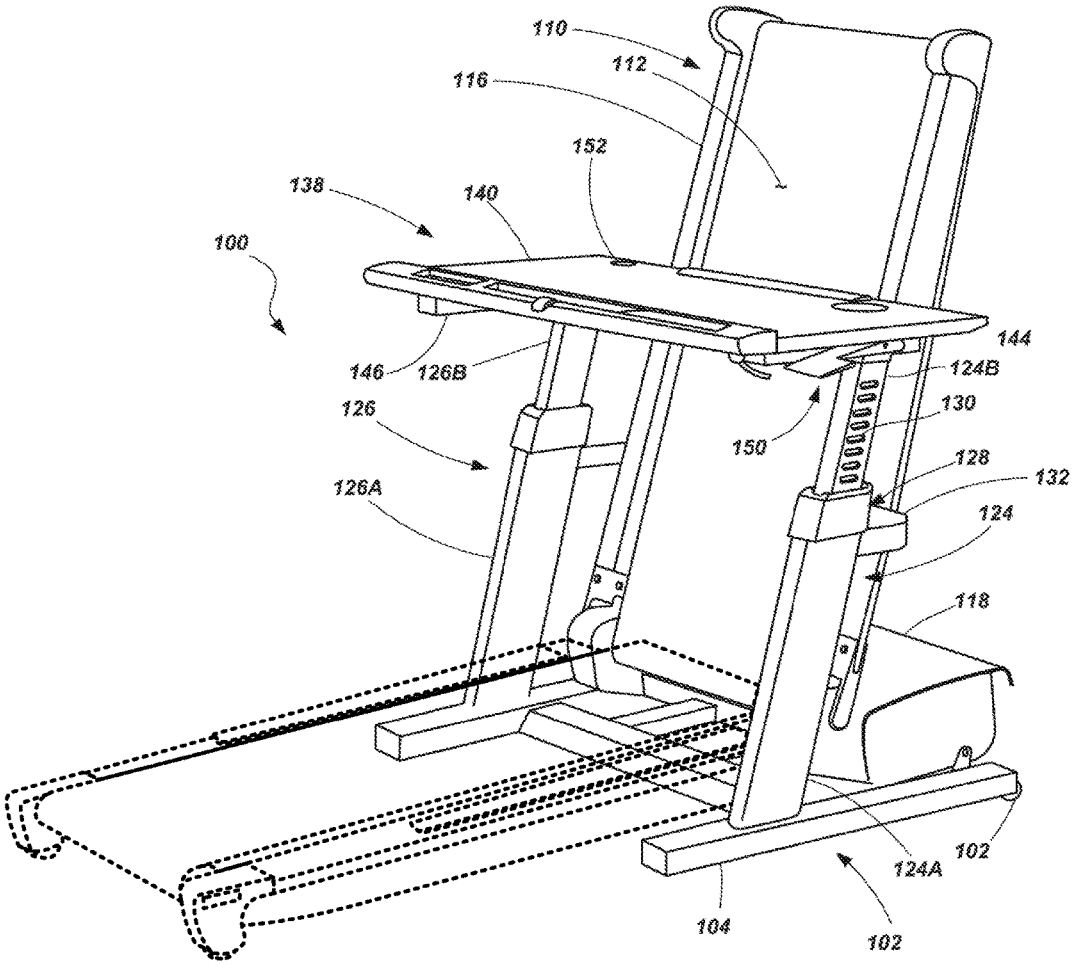
FIG. 5 is a perspective view of the exercise apparatus of FIG. 4 with the working surface pivoted back to its original position.

For example, a release mechanism 150 associated with one support arm 144 selectively locks or latches the working surface 140 in a first position (e.g., as shown in FIGS. 1 and 2), or release the working surface 140 from one support arm 144 so that the working surface 140 may be displaced about a pivot mechanism 152 that is coupled with the other support arm 146 or columnar member 126 to a second position (e.g., as shown in FIGS. 3 and 4). In one embodiment, the release mechanism 150 may include a lever associated with a lock or latch that engages and disengages the working surface 140 or some component associated with the working surface. Actuating the release mechanism 150 enables the working surface 140 to be pivoted away from and out of the "running path" defined by the deck 110 and its circuitous belt 112 while it is still supported by one of the columnar members (e.g., 126). With the working surface 140 in the second position, the deck 110 may displace from a first, operational position as shown in FIG. 3, to a stored position as shown in FIG. 4. After the deck 110 is moved into its stored position, the working surface may be pivoted back to its first position and again latched and/or locked with the support arm 144 as shown in FIG. 5.

The desk 138 may be move from the first position to the second position through any appropriate type of mechanism. For example, the desk 138 may pivot from the first position to the second position by rotating about a pivot rod. In other examples, the desk 138 may slide from the first position to the second position along a linear track. In yet other examples, the desk 138 may move from a first position to a second position through a hinge joint. In some of the examples of the present invention, the desk moves from the first position to the second position such that the working surface of the desk 138 maintains a level orientation. For example, in the first position, the working surface may reside within a plane that is aligned with the floor or other support structure on which the exercise machine rests. In the second position, the working surface may also reside within that same plane or at least reside in a plane that is aligned with the plane of the first position. During the transition from the first plane to the second plane, the working surface of the desk 138 may remain within the same plane or substantially within that plane as the desk 138 moves.

As the desk 138 moves from the first position to the second position, the desk 138 moves away from being positioned over the running path. As a result, the desk 138 is no longer above the running deck 110. With the desk 138 out of the way, the running deck 110 may be pivoted upward at a front end. As the desk is pivoted upward, a portion of the running deck 110 passes the desk 138. In examples, where the desk 138 is moved about a pivot rod, the running desk 110 may be moved past the pivot rod. With the running deck 110 past the pivot rod, the desk 138 may be moved back into the first position. In such an example, the desk 138 is now positioned in front of the running deck 110. In examples where the desk 138 latches or is otherwise locked during to the frame posts in the first position, the desk 138 contributes to locking the running deck 110 in an upright position.

The treadmill 100 may include a variety of other features, mechanisms, and devices. For example, a variety of input and output devices 160 may be coupled with the working surface 140 (or with some other component of the treadmill) associated with the operation of the treadmill 100. The input and output devices 160 may include, for example, one or more control buttons or function keys used to control various aspects of operating the treadmill 100 such as on/off buttons or switches, speed control keys, incline control keys, keys for implementing workout programs, or other input devices. Additionally, the input and output devices may include one or more displays to provide a variety of information including, for example, information about the status of one or more operational characteristics of the treadmill 100 (e.g., speed, incline, programmed workout regimes, etc.) or information regarding a user's workout (e.g., distance traveled, calories burned, etc.).

In other embodiments, various electrical and communications connections may be associated with the treadmill 100. For example, USB or other types of connections may be associated with the desk 138 to connect computing and communication devices, including, but not limited to, smart phones, tablet style computing devices, laptop or desktop computers, computer displays, and the like. Additionally, power connections may be coupled with the desk, the frame 102, or some other component to enable powering and charging of computing and communications devices at a central location associated with the desk 138.

Another example of an additional feature may include wheels 170 or rollers associated with the base frame 102, the deck 110, or both, to assist in moving the treadmill 100 from one location to another within, for example, an office or a home. Yet another feature may include, for example, lift assist mechanisms that assist with displacing the deck 110 from an operational position to a stored position and vice versa.

Figure 6:
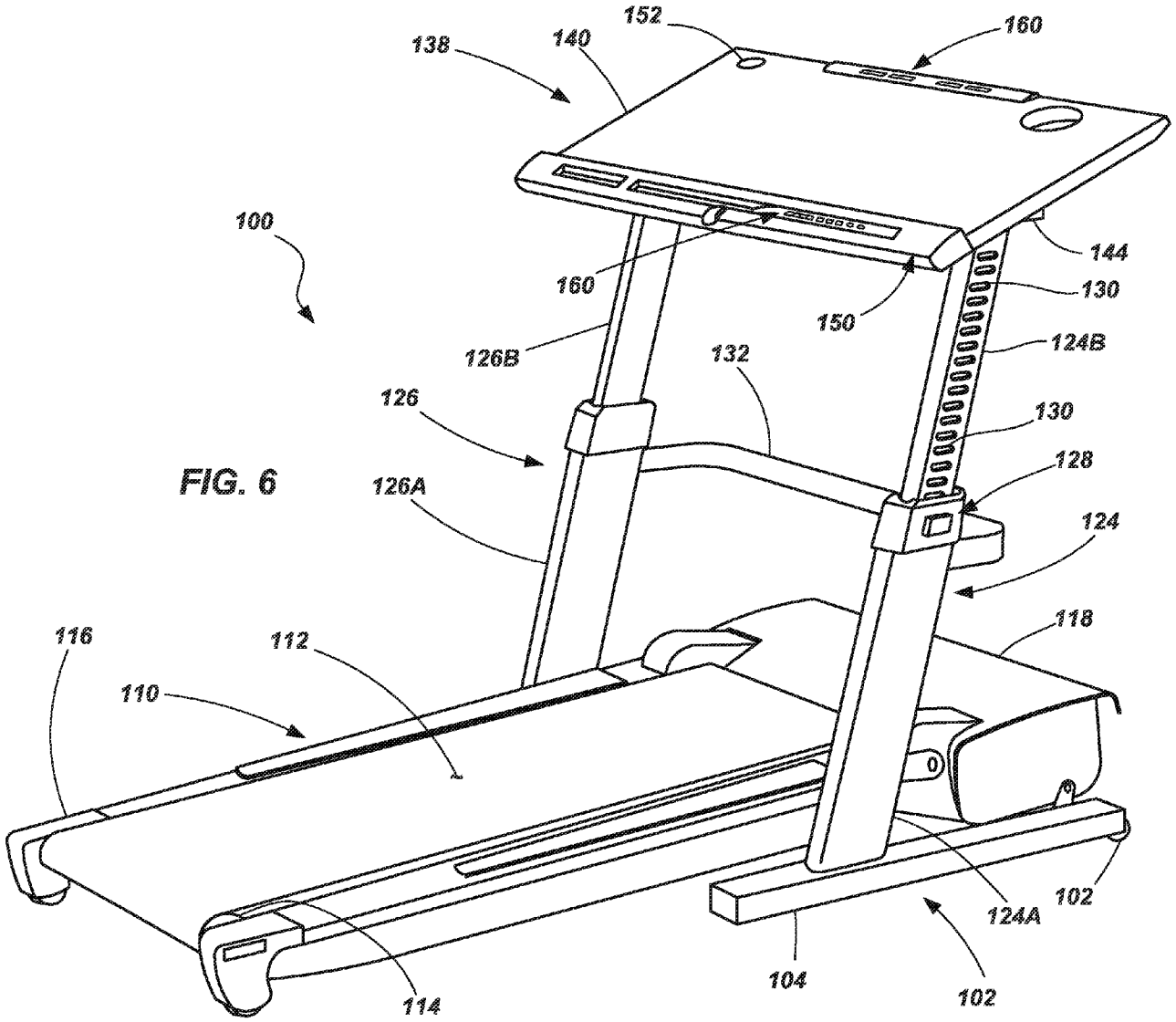
FIG. 6 is a perspective view of an example of an exercise apparatus with various components adjusted to specific positions in accordance with the present disclosure.
Figure 7:
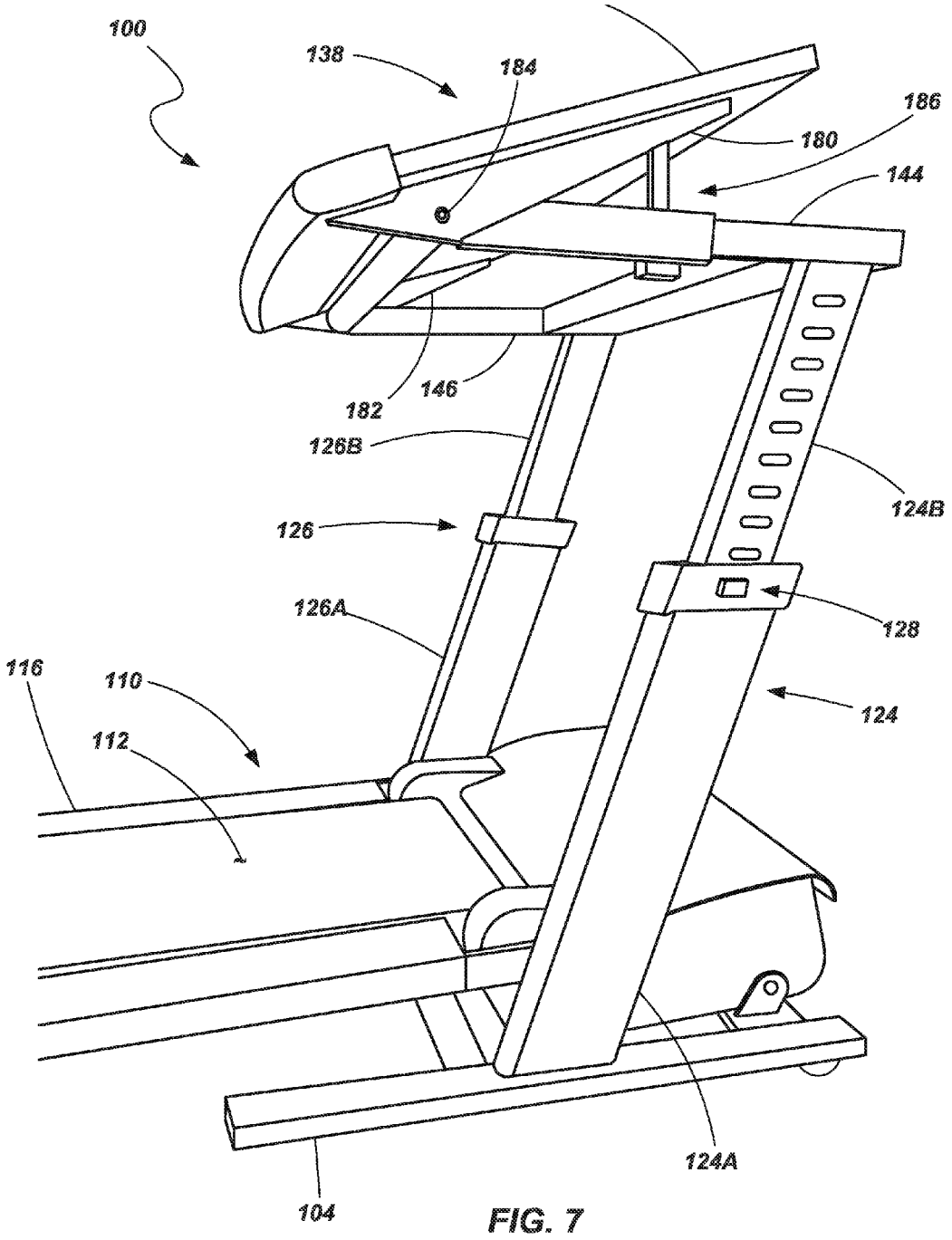
FIG. 7 is a rotated view of the exercise device of FIG. 6.

Referring to FIGS. 6 and 7, the treadmill 100 is depicted. The working surface 140 of the desk 138 is tilted or angled relative to a horizontal plane. In one embodiment, the working surface 140 may be coupled with frame members 180 and 182. A pivoting connection 184 may be formed between the frame members 180 and 182 and associated support arms 144, 146 at a location near the front edge of the working surface. Such an arrangement enables the rear edge of the working surface 140 to be vertically displaced relative to the support arms 144, 146 altering the working angle of the working surface 140.

An adjustment mechanism 186 may be used to assist in selectively adjusting the working surface to any of a number of user selected angles. In one embodiment, the adjustment mechanism 186 may include an actuating device, such as an electric motor, a jack screw, or a hydraulic or pneumatic cylinder. The actuator may be controlled, for example, by an input device 160 (see FIG. 1) which may be integrated into the working surface 140.

Figure 8:
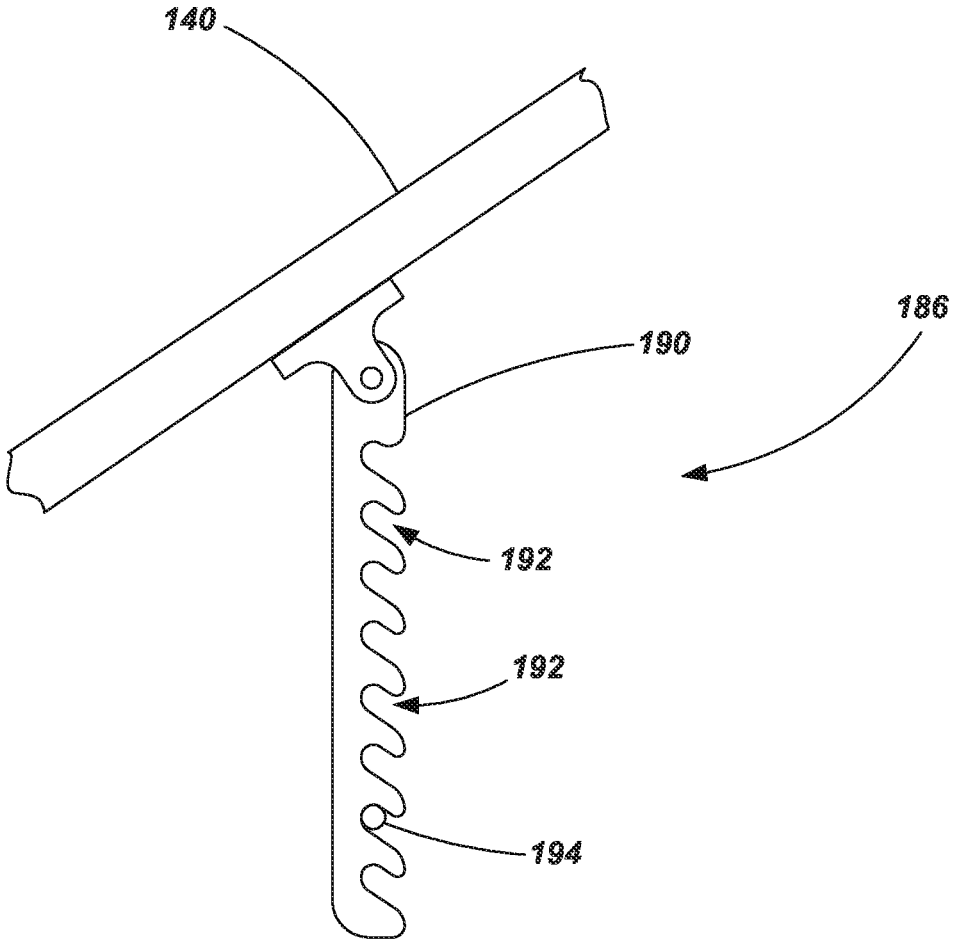
FIG. 8 is a detailed view of an example of certain components of an exercise device in accordance with the present disclosure.

FIG. 8 shows details of another embodiment of an adjustment mechanism 186 wherein a first support member 190 is pivotally coupled with the working surface 140 and includes a plurality of angled slots 192 defined therein. A second support member 194 may be coupled to a support arm (e.g., 144) or some other component (e.g., a cross member between the support arms or a columnar member) and is shaped to selectively engage the angled slots 192 of the first support member 190. To adjust the angle of the working surface 140, a user may lift the rear edge of the working surface 140 causing the first support member 190 to be displaced with it. The user may then determine the desired angle of the working surface and allow an angled slot 192 that corresponds with the desired angle of the working surface 140 to engage the second support member, retaining it in the desired angle. In returning the working surface to a more horizontal position (e.g., as shown in FIGS. 1-5), a user may again lift the rear edge of the working surface 140 causing the support member 194 to be disengaged from the angled slot 192. The adjustment mechanism 186 may then be oriented away from the support members allowing the working surface to return to horizontal position.

In one embodiment, a single adjustment mechanism 186 may be used in adjusting the tilt or incline of the working surface 140. For example, a single adjustment mechanism may be positioned adjacent one of the support arms 144, 146, or it may be positioned between the support arms and coupled to a cross member or other structural component. In another embodiment, multiple adjustment mechanisms may be used. For example, an adjustment mechanism (whether utilizing an actuator, a support member with angled slots or some other arrangement) may be positioned adjacent each of the support arms 144 and 146 to provide a desired level of stability and rigidity to the working surface when in an inclined position.

Figure 9:
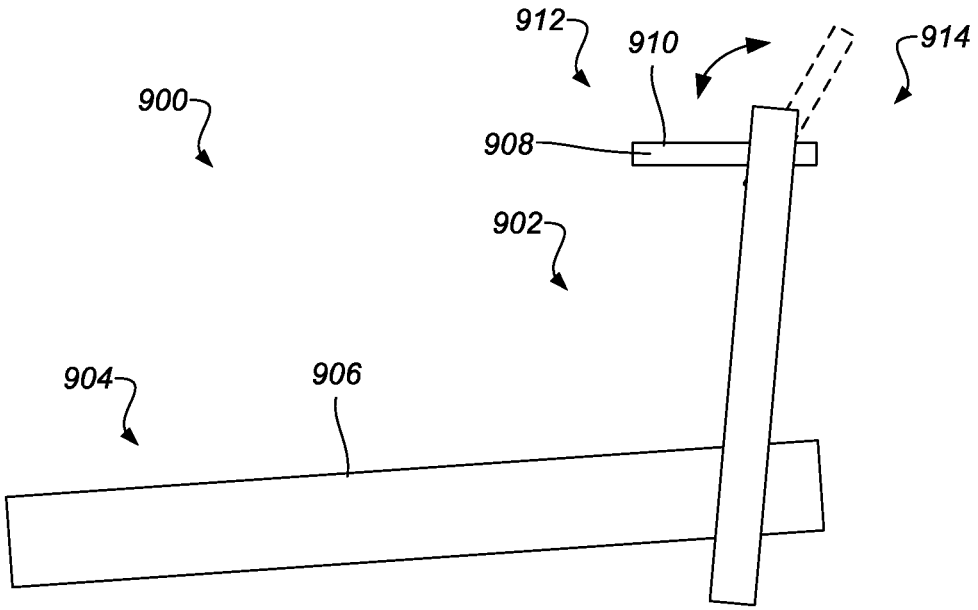
FIG. 9 is a detailed view of an example of an exercise device in accordance with the teachings of the present disclosure.

In the example of FIG. 9, the exercise apparatus 900 includes a frame 902 and a treadmill deck 904 moveably coupled with the frame 902. The treadmill deck 904 defines a running path 906. A desk 908 includes a working surface 910, which is selectively positionable between a first position 912 where the working surface 910 is positioned above a portion of the running path 906 and a second position 914 wherein the working surface 910 is displaced away from the running path 906.

Figure 10:
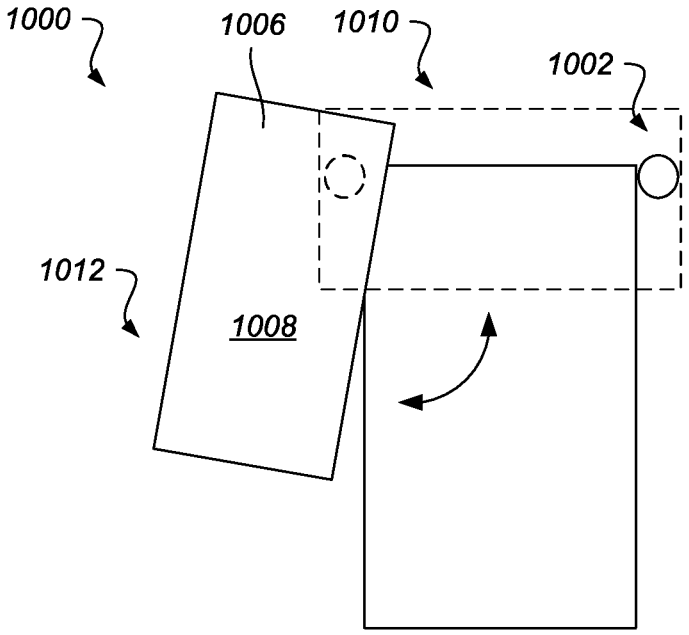
FIG. 10 is a detailed view of an example of an exercise device in accordance with the teachings of the present disclosure.

In the example of FIG. 10, the exercise apparatus 1000 includes a frame 1002 and a treadmill deck 1004 movably coupled with the frame 1002. The treadmill deck 1004 defines a running path. A desk 1006 includes a working surface 1008, which is selectively positionable between a first position 1010 where the working surface 1008 is positioned above a portion of the running path and a second position 1012 wherein the working surface 1008 is displaced away from the running path laterally.

INDUSTRIAL APPLICABILITY

In general, the invention disclosed herein may provide an exercise apparatus that may be used in office environments. For example, a treadmill such as described herein enables a user to walk or exercise in their place of work. This enables a person to multitask if desired, and certainly provides convenience in the timing and location of a person's workout. For example, the user may choose to walk at a moderate pace on the treadmill while doing other activities such as reviewing or revising various documents (either physical documents or electronic documents on a computer). Alternatively, if desired, a user may place the deck of the treadmill in a stored position when done exercising and then use the desk for working purposes.

The pivoting arrangement of the working platform enables use and storage of the treadmill (both as an exercise apparatus and as a desk) in a desired location without requiring a substantial amount of space. Thus, for example, a user may use a single room in their home as both an exercise room as well as a home office. Of course, the treadmill may be used at a business office as well. The ability to conveniently keep a treadmill in one's office provides opportunities to move, be active, and reduce the sedentary nature of working at a desk on a daily basis.

The combination of a desk coupled to the same base member as the treadmill provides substantial stability to both the desk and the treadmill. The adjustability of the treadmill as described herein enables a user to adjust the height of their desk (e.g., the working platform) so that they may use it in a variety of configurations. For example, one may use the desk while walking or running on the treadmill with the desk adjusted to a user's height. Additionally, the desk may be used when the deck of the treadmill is folded into a stored position and they are standing on the ground rather than standing on the deck. The height of the working platform may be adjustable to accommodate such a difference in height when the user is standing on the deck verses standing on the floor. Additionally, a user may use the desk while sitting in a chair when the deck rotated up into the stored position. Again, the adjustable height of the desk enables any of these scenarios.

Integration of the control modules into the working surface enables a user to control operational characteristics of the treadmill (e.g., speed, incline, selection of specific workout programs) while still having working matters in front of them on the desk.

Connection ports, power ports, and other types of ports may be integrated into the working surface. Such ports may enable connectivity of a computer or other device (such as a phone or tablet). The connected device may be used to connect with a network or may be used to control the operation of the treadmill. For example, an iPhone, Android phone, or tablet style computing device may include an application designed to control the operation of the treadmill when connected to the exercise machine though one of the port. In other examples, such objects (e.g. smart phones, electronic tablets, etc.) may be in wireless communication with the exercise machine. Such wireless communications may include any appropriate protocol or communication format, such as Wi-Fi, Bluetooth, Z-wave, other protocols, other platforms, or combinations thereof.

Assist devices (e.g., biasing members or damping mechanisms) may be used to assist in adjusting the desk. For example, the weight of the desk may be substantially countered by a biasing mechanism such that a downward force is applied to adjust the height of the desk downwards. Such a mechanism may have a minimal (or even no) upward force applied to the desk to adjust the height of the desk upwards.

The ability to selectively define the desk's working surface angle relative to horizontal enables a user to tailor their working environment, whether or not they are using the desk while exercising. In some instances, individuals prefer to have a working surface that is not horizontal (or substantially horizontal). For example, some individuals may desire to use the working surface of their desk for drafting or drawing purposes. An inclined surface lends itself to such a purpose. Additionally, while running on a treadmill, a user may find it more convenient to have an inclined surface on which to read or review documents.

The exercise apparatus may include a frame and a treadmill deck hingedly coupled with the frame. The treadmill deck may define a running path on which a user may walk or run during an exercise session. However, the running path may be used for other purposes, such as riding a bicycle or operating another man-powered vehicle. The treadmill also includes a desk with a working surface. The working surface of the desk can be selectively positionable between a first position and a second position. The first position may be positioned above the running surface. The second position may be displaced from the running surface.

For example, when the working surface of the desk is superjacent the running path, the working surface may be oriented such that a user walking or running on the working surface may place an object on the desk to use during the workout. For example, the objects may be a book, a water bottle, an electronic tablet, a computing device, a radio, a display, an entertainment device, another type of device, or combinations thereof.

When the desk is in the second position, the desk may be moved laterally away from being superjacent the running path. In such an example, the desk may be rotated away from being over the treadmill deck. With the desk out of the way, the treadmill deck may be pivoted upwards into an upright position. When the desk is in the first position, the desk prevents the movement of the treadmill deck into the upright position, which can be a storage position. After the treadmill deck is in the storage position, the desk may be rotated back into the first position again. While in the first position and with the treadmill deck in the storage position, the desk is superjacent the running path defined by the treadmill deck when the treadmill deck is lowered into an operational position. In other words, the running path is defined by the treadmill deck when the treadmill deck is in the operational position, but movement of the treadmill deck into the storage position does not change the location of the running path because a user cannot run on treadmill deck with the treadmill deck is in the storage position. The desk may be moved back into the first position when the treadmill deck is in the storage position. In such a situation, the desk is between the underside of the treadmill deck and the spatial location of where the running path would be if the treadmill deck were in the operational position.

Thus, the desk can swing laterally between positions where the desk/working surface is over the area where a user can run or walk. While the desk is rotated out of the way, the treadmill deck can be pivotally raised and/or pivotally lowered between an upright storage position and a substantially horizontal operational position.

The desk may be move from the first position to the second position through any appropriate type of mechanism. For example, the desk may pivot from the first position to the second position by rotating about a pivot rod. In other examples, the desk may slide from the first position to the second position along a linear track. In yet other examples, the desk may move from a first position to a second position through a hinge joint. In some of the examples of the present invention, the desk moves from the first position to the second position such that the working surface of the desk maintains a level orientation. For example, in the first position, the working surface may reside within a plane that is aligned with the floor or other support structure on which the exercise machine rests. In the second position, the working surface may also reside within that same plane or at least reside in a plane that is aligned with the plane of the first position. During the transition from the first plane to the second plane, the working surface of the desk may remain within the same plane or substantially within that plane as the desk moves.

As the desk moves from the first position to the second position, the desk moves away from being positioned over the running path. As a result, the desk is no longer above the running deck. With the desk out of the way, the running deck may be pivoted upward at a front end. As the desk is pivoted upward, a portion of the running deck passes the desk. In examples, where the desk is moved about a pivot rod, the running desk may be moved past the pivot rod. With the running deck past the pivot rod, the desk may be moved back into the first position. In such an example, the desk is now positioned in front of the running deck. In examples where the desk latches or is otherwise locked during to the frame posts in the first position, the desk contributes to locking the running deck in an upright position.

For example, a release mechanism associated with one support arm selectively locks or latches the working surface in a first position or release the working surface from one support arm so that the working surface may be displaced about a pivot mechanism that is coupled with the other support arm or columnar member to a second position. In one embodiment, the release mechanism may include a lever associated with a lock or latch that engages and disengages the working surface or some component associated with the working surface. Actuating the release mechanism enables the working surface to be pivoted away from and out of the running path defined by the deck and its circuitous belt while it is still supported by one of the columnar members. With the working surface in the second position, the deck may displace from a first, operational position to a stored position. After the deck is moved into its stored position, the working surface may be pivoted back to its first position and again latched and/or locked with the support arm.

The frame may be attached to a first columnar member and a second columnar member. The first columnar member may be positioned on a first side of the treadmill deck, and the second columnar member may be positioned on the second side of the treadmill deck. When the desk is in the first position, the desk is supported by both the first and second columnar members. In one example, when the desk pivots laterally to the side, the desk is disconnected from the first columnar member and is supported by the second columnar member as the desk pivots away. In another example, the desk is disconnected from the second columnar member when the desk pivots laterally to the side, and desk is supported by the first columnar member as the desk pivots away. When the desk is in the first position, the desk may be selectively attached to at least one of the columnar members. For example, the desk may be snapped, wedged, strapped, fastened, latched, or otherwise attached to the columnar member. To allow the desk to pivot into the second position, the desk may be selectively unattached before the desk is free to move.

As the desk moves, the working surface may remain substantially within a common plane as it pivots from a first position to a second position and vice versa. In other words, the path that the desk takes as it travels from the first position to the second position and vice versa may be a substantially level path with minimal vertical components. In other examples, at least part of the swing path from the first position to the second position includes a vertical component.

The columnar members may include an upper portion and a lower portion. The upper and lower portions may be movable with respect to each other. For example, either the lower portions or the upper portions may telescope with respect to the other. In a different embodiment, the upper and lower portions may be hingedly attached to each other such that the columnar members can fold.

Further, the desk may include at least one user input that may execute at least one function of the exercise machine. For example, the user inputs may cause an operating parameter of the exercise machine to change, such as a resistance, a speed, an incline, a volume, another operating parameter, or combinations thereof. Further, at least one output is incorporated into the desk. Such outputs may include a display, a speaker, or another type of output. Such outputs may present to the user entertainment, physiological parameters of the user, timers, information about the workout, other types of information, or combinations thereof.

The inputs and/or the outputs may be in communication with a processor that is also integrated into the desk. In other examples, the inputs and/or outputs may be in communication with a processor that is located in another part of the exercise machine. In such an example, the inputs and/or outputs may be in wireless communication with the processor. Any appropriate wireless protocol may be used. In other examples, the inputs and/or outputs may be hardwired to the processor when the processor is located elsewhere on the exercise machine.

The desk may have any appropriate dimensions. For example, the desk may be longer than the width of the running deck. In other examples, the desk's length is shorter than the width of the running deck. Further, the first position and the second position may be offset from each other by any appropriate distance and/or angle. In some examples, the angular difference between the first position and the second position is 90 degrees. In other examples, the angular difference is between 135 degrees and 45 degrees, between 125 degrees and 55 degrees, between 115 degrees and 65 degrees, between 105 degrees and 75 degrees, between 95 degrees and 85 degrees, between another set of degrees, or combinations thereof.

Further, the desk may be made of any appropriate type of material, such as wood, plastic, metal, steel, composite, another type of material, or combinations thereof. In some examples, the desk is supported by the first and second posts in the first position. However, in the second position, the desk may be unsupported on one side. In such an example, the desk is made of a material that is sufficiently rigid to maintain its substantially level orientation without support from one side. In addition, the desk may be made of a material that is sufficiently strong to hold an object, such as a mobile device, electronic tablet, a computer, an entertainment device, a book, a water bottle, another type of device, or combinations thereof, while being supported on just one side.

While the invention may be susceptible to various modifications and alternative forms, specific embodiments have been shown by way of example in the drawings and have been described in detail herein. However, the invention is not intended to be limited to the particular forms disclosed. For example, while multiple embodiments are described, features of one embodiment may be combined with features of other embodiments without limitation. Thus, the invention includes all modifications, equivalents, and alternatives falling within the spirit and scope of the invention as defined by the following appended claims.

What is claimed is:

1. An exercise apparatus, comprising:

a base frame;

a treadmill deck coupled with the base frame; and a desk including a working surface selectively positionable between a first position where the working surface lies in a first plane and a second position where the working surface lies in a second plane, wherein the first plane and the second plane intersect at an angle that is less than 180 degrees, wherein the treadmill deck is configured to be pivotably displaceable on the base frame between an active position for use in running or walking and a storage position, and wherein the desk in the first position is between the treadmill deck in the storage position and the space described by the treadmill deck when in the active position.

2. The exercise apparatus of claim 1, further comprising two columnar members coupled generally perpendicularly to the base frame, wherein the working surface is supported by the columnar members.

3. The exercise apparatus of claim 2, further comprising two support arms, one coupled to each columnar member;

wherein the working surface is pivotally coupled to each of the support arms.

4. An exercise apparatus, comprising:

a base frame;

a treadmill deck coupled with the base frame;

a desk including a working surface selectively positionable between a first position where the working surface lies in a first plane and a second position where the working surface lies in a second plane, wherein the first plane and the second plane intersect at an angle that is less than 180 degrees; and an actuator configured to move the working surface between the first position and the second position, wherein the treadmill deck is configured to be pivotably displaceable on the base frame between an active position for use in running or walking and a storage position, and wherein the desk in the first position is between the treadmill deck in the storage position and the space described by the treadmill deck when in the active position.

5. The exercise apparatus of claim 4, wherein the working surface is at a first height relative to the treadmill deck while in the first position and at a second height relative to the treadmill deck while in the second position.

6. The exercise apparatus of claim 4, further comprising two columnar members coupled generally perpendicularly to the base frame and two support arms, one coupled to each columnar member;

wherein the working surface is coupled to each of the support arms.

7. The exercise apparatus of claim 6, wherein the working surface is pivotally coupled to each of the support arms.

8. An exercise apparatus, comprising:

a base frame;

two columnar members coupled generally perpendicularly to the base frame;

two support arms, one coupled to each columnar member;

a treadmill deck coupled with the base frame and including:

a deck frame;

a pair of spaced apart rollers coupled to the deck frame; and a circuitous belt extending about the pair of rollers;

a desk pivotally coupled to each of the support arms and including a working surface selectively positionable between a first position where the working surface lies in a first plane and a second position where the working surface lies in a second plane; and an adjuster that selectively maintains the desk in at least two different angular positions relative to the support arms, wherein the first plane and the second plane intersect at an angle that is less than 180 degrees, wherein the treadmill deck is configured to be pivotably displaceable on the base frame between an active position for use in running or walking and a storage position, and wherein the desk in the first position is between the treadmill deck in the storage position and the space described by the treadmill deck when in the active position.

9. The exercise apparatus of claim 8, wherein the desk is configured to pivot about the longitudinal axis of one columnar member.

10. The exercise apparatus of claim 8, wherein the adjuster includes a first support member coupled with the working surface and a second support member that selectively engages the first support member to set the height or angle of the working surface at a selected position.

11. The exercise apparatus of claim 10, wherein the first support member includes a plurality of slots and wherein the second support member comprises a pin configured to engage with the slots.

12. The exercise apparatus of claim 11, wherein the adjuster further comprises an actuator.

13. The exercise apparatus of claim 12, wherein the actuator comprises an electric motor, a hydraulic cylinder, or a pneumatic cylinder.

14. The exercise apparatus of claim 13, further comprising an electronic input device and an electronic output device integrated into the desk.

15. The exercise apparatus of claim 14, wherein the electronic input device comprises a switch or a button.

16. The exercise apparatus of claim 14, wherein the electronic output device includes a display.

* * * * *